US010151020B2

(12) United States Patent
Mizutani et al.

(10) Patent No.: US 10,151,020 B2
(45) Date of Patent: Dec. 11, 2018

(54) FERRITIC STAINLESS STEEL FOIL

(71) Applicant: JFE Steel Corporation, Tokyo (JP)

(72) Inventors: Akito Mizutani, Tokyo (JP); Mitsuyuki Fujisawa, Tokyo (JP); Hiroyuki Ogata, Tokyo (JP)

(73) Assignee: JFE Steel Corporation (JP)

( * ) Notice: Subject to any disclaimer, the term of this patent is extended or adjusted under 35 U.S.C. 154(b) by 298 days.

(21) Appl. No.: 14/907,690

(22) PCT Filed: Jul. 16, 2014

(86) PCT No.: PCT/JP2014/003747
§ 371 (c)(1),
(2) Date: Jan. 26, 2016

(87) PCT Pub. No.: WO2015/015728
PCT Pub. Date: Feb. 5, 2015

(65) Prior Publication Data

US 2016/0160328 A1 Jun. 9, 2016

(30) Foreign Application Priority Data

Jul. 30, 2013 (JP) ..... 2013-157537

(51) Int. Cl.
*C22C 38/52* (2006.01)
*C22C 38/48* (2006.01)
(Continued)

(52) U.S. Cl.
CPC ..... *C22C 38/52* (2013.01); *C21D 1/74* (2013.01); *C21D 6/002* (2013.01); *C21D 8/0236* (2013.01);
(Continued)

(58) Field of Classification Search
CPC ..... Y10T 428/12972; Y10T 428/12979; Y10T 428/1266; Y10T 428/12667;
(Continued)

(56) References Cited

U.S. PATENT DOCUMENTS 3,920,583 A 11/1975 Pugh et al.
4,277,374 A 7/1981 Lula et al.
(Continued)

FOREIGN PATENT DOCUMENTS

CN 1662666 8/2005
CN 101688280 3/2010
(Continued)

OTHER PUBLICATIONS

JP3431712_MT. Jun. 28, 2003.*
(Continued)

*Primary Examiner* — Michael E. La Villa
(74) *Attorney, Agent, or Firm* — DLA Piper LLLP (US)

(57) ABSTRACT

The ferritic stainless steel foil has a composition containing, by mass %, C: 0.050% or less, Si: 0.20% or less, Mn: 0.20% or less, P: 0.050% or less, S: 0.0050% or less, Cr: 10.5% or more and 20.0% or less, Ni: 0.01% or more and 1.00% or less, Al: more than 1.5% and less than 3.0%, Cu: 0.01% or more and 1.00% or less, N: 0.10% or less, and further contains one or more elements selected from Ti: 0.01% or more and 1.00% or less, Zr: 0.01% or more and 0.20% or less, and Hf: 0.01% or more and 0.20% or less, and the balance being Fe and inevitable impurities. This enables a composite layer of an Al oxide layer and a Cr oxide layer to be formed on the surface of the ferritic stainless steel foil in a high-temperature oxidizing atmosphere at 800° C. or more.

4 Claims, 2 Drawing Sheets

(51) Int. Cl.

| | |
|---|---|
| ***C22C 38/00*** | (2006.01) |
| ***C22C 38/06*** | (2006.01) |
| ***C22C 38/04*** | (2006.01) |
| ***C22C 38/02*** | (2006.01) |
| ***C22C 38/50*** | (2006.01) |
| ***C22C 38/44*** | (2006.01) |
| ***B32B 15/00*** | (2006.01) |
| ***C23C 26/00*** | (2006.01) |
| ***C23C 30/00*** | (2006.01) |
| ***C23C 8/14*** | (2006.01) |
| ***C23C 8/18*** | (2006.01) |
| ***C21D 1/74*** | (2006.01) |
| ***C21D 6/00*** | (2006.01) |
| ***C21D 8/02*** | (2006.01) |
| *C21D 1/76* | (2006.01) |
| *C21D 9/46* | (2006.01) |

(52) U.S. Cl.
CPC ..... *C22C 38/00* (2013.01); *C22C 38/001* (2013.01); *C22C 38/002* (2013.01); *C22C 38/004* (2013.01); *C22C 38/005* (2013.01); *C22C 38/02* (2013.01); *C22C 38/04* (2013.01); *C22C 38/06* (2013.01); *C22C 38/44* (2013.01); *C22C 38/48* (2013.01); *C22C 38/50* (2013.01); *C23C 8/14* (2013.01); *C23C 8/18* (2013.01); *C21D 1/76* (2013.01); *C21D 9/46* (2013.01); *C21D 2211/005* (2013.01); *Y10T 428/12611* (2015.01); *Y10T 428/12618* (2015.01); *Y10T 428/12667* (2015.01); *Y10T 428/12972* (2015.01); *Y10T 428/12979* (2015.01); *Y10T 428/24967* (2015.01); *Y10T 428/24975* (2015.01); *Y10T 428/263* (2015.01); *Y10T 428/264* (2015.01); *Y10T 428/265* (2015.01)

(58) Field of Classification Search
CPC ..... Y10T 428/12611; Y10T 428/12618; Y10T 428/24967; Y10T 428/24975; Y10T 428/263; Y10T 428/264; Y10T 428/265
See application file for complete search history.

(56) References Cited

U.S. PATENT DOCUMENTS

| | | | | |
|---|---|---|---|---|
| 6,086,689 | A | 7/2000 | Sassoulas et al. | |
| 2005/0045250 | A1* | 3/2005 | Rakowski | C22C 38/005 148/241 |
| 2007/0110609 | A1 | 5/2007 | Hattendorf et al. | |
| 2008/0035247 | A1* | 2/2008 | Fujita | C23C 2/02 148/522 |
| 2011/0031235 | A1 | 2/2011 | Hattendorf | |
| 2015/0010771 | A1 | 1/2015 | Mizutani et al. | |

FOREIGN PATENT DOCUMENTS

| | | | |
|---|---|---|---|
| EP | 1 295 959 | | 3/2003 |
| EP | 1 873 271 | | 1/2008 |
| EP | 2 166 120 | | 3/2010 |
| JP | 7-213918 | A | 8/1995 |
| JP | 7-275715 | A | 10/1995 |
| JP | 9-268350 | A | 10/1997 |
| JP | 10-251750 | A | 9/1998 |
| JP | 2004-307918 | A | 11/2004 |
| JP | 2006-009119 | | 1/2006 |
| JP | 2006-519929 | A | 8/2006 |
| WO | 2013/114833 | A1 | 8/2013 |

OTHER PUBLICATIONS

JP3224694-MT. Nov. 5, 2001.*
JP 2009293106 A_MT. Dec. 17, 2009.*
Korean Office Action dated Sep. 26, 2017, of corresponding Korean Application No. 10-2015-7035904, along with a Concise Statement of Relevance of Office Action in English.
Supplementary European Search Report dated Apr. 18, 2016, of corresponding European Application No. 14832902.2.
Chinese Office Action dated Sep. 1, 2016, of corresponding Chinese Application No. 201480043102.X, along with a Search Report in English.

* cited by examiner

FERRITIC STAINLESS STEEL FOIL

TECHNICAL FIELD

This disclosure relates to a ferritic stainless steel foil having high oxidation resistance, high shape stability at high temperatures, high adhesion to an oxide layer, and high adhesion to a catalyst coat and particularly relates to a ferritic stainless steel foil suitably used as a material of a catalyst carrier for exhaust gas purifying facilities included in automobiles, agricultural machinery, building machinery, industrial machinery, and the like.

BACKGROUND

Ceramic honeycombs and metal honeycombs composed of a stainless steel foil have been widely used as a catalyst carrier for exhaust gas purifying facilities included in automobiles, agricultural machinery, building machinery, industrial machinery, and the like. Among these honeycombs, recently, metal honeycombs have been increasingly used since they allow a higher aperture ratio to be achieved and have higher resistance to thermal shock and higher vibration resistance than ceramic honeycombs.

A metal honeycomb has a honeycomb structure formed by, for example, stacking a flat stainless steel foil (flat foil) and a stainless steel foil that has been worked into a corrugated shape (corrugated foil) alternately. A catalytic material is applied onto the surface of the stainless steel foil, and the resulting metal honeycomb is used in an exhaust gas purifying facility. When a catalytic material is applied onto the surface of the stainless steel foil, the stainless steel foil is commonly coated with $\gamma$-$Al_2O_3$ to form a wash coat layer and a catalytic material such as Pt or Rh is applied to the wash coat layer.

FIG. 1 illustrates an example of a metal honeycomb. The metal honeycomb illustrated in FIG. 1 is a metal honeycomb 4 prepared by stacking a flat foil 1 and a corrugated foil 2 composed of a stainless steel foil, winding the resulting product into a roll shape, and fixing the periphery of the wound product in place with an external cylinder 3 composed of a stainless steel.

Because the metal honeycomb is exposed to a high-temperature exhaust gas, a material of the metal honeycomb, that is, a stainless steel foil, is required to have high oxidation resistance. The material of the metal honeycomb, that is, the stainless steel foil, is also required to have high adhesion (adhesion to a catalyst coat) to a catalyst coat (wash coat layer on which a catalytic material is deposited).

For the above-described reasons, hitherto, high-Al-content ferritic stainless steel foils such as a 20 mass % Cr-5 mass % Al ferritic stainless steel foil and a 18 mass % Cr-3 mass % Al ferritic stainless steel foil have been primarily used as a stainless steel foil to form a catalyst carrier for exhaust gas purifying facilities such as a metal honeycomb.

When Al is added to a stainless steel such that the Al content in the stainless steel is 3 mass % or more, the surface of the stainless steel can be protected by an Al oxide layer mainly composed of $Al_2O_3$, which markedly enhances oxidation resistance. Moreover, corrosion resistance at high temperatures can also be markedly enhanced. The Al oxide layer has a high affinity for a $\gamma$-$Al_2O_3$ coat (wash coat) commonly used to deposit a catalyst on the foil and, therefore, has high adhesion to a catalyst coat (adhesion between the oxide layer and the wash coat). Thus, a high-Al-content ferritic stainless steel foil having an Al content of 3 mass % or more has markedly high adhesion to a catalyst coat.

High-Al-content ferritic stainless steel foils have been widely used as a material of a catalyst carrier since they have high oxidation resistance and high adhesion to a catalyst coat. In particular, exhaust gas purifying facilities of gasoline-powered automobiles, in which the temperature of the exhaust gas reaches 1000° C. or more, include a catalyst carrier composed of a 20 mass % Cr-5 mass % Al ferritic stainless steel foil or a catalyst carrier composed of a 18 mass % Cr-3 mass % Al ferritic stainless steel foil, which have markedly high oxidation resistance.

On the other hand, the temperature of exhaust gas of diesel-powered automobiles does not increase as high as the temperature of exhaust gas of gasoline-powered automobiles, and the temperature reached is generally about 800° C. The highest temperature reached by exhaust gas of agricultural machinery, building machinery, industrial machinery, a factory or the like is even lower than the highest temperature reached by exhaust gas of diesel-powered automobiles. Therefore, a material of a catalyst carrier for exhaust gas purifying facilities included in diesel-powered automobiles, industrial machinery and the like, in which the temperature of exhaust gas is relatively low, is not required to have markedly high oxidation resistance comparable to those of a 20 mass % Cr-5 mass % Al ferritic stainless steel foil and a 18 mass % Cr-3 mass % Al ferritic stainless steel foil.

Furthermore, the production efficiency of a high-Al-content ferritic stainless steel foil having an Al content of 3 mass % or more is low, which increases the production cost, while the high-Al-content ferritic stainless steel has high oxidation resistance and high adhesion to a catalyst coat. Because adding a large amount of Al to a ferritic stainless steel significantly reduces the toughness of the ferritic stainless steel, cracking may occur while a cast slab is cooled, and rupturing of a steel sheet may often occur during a treatment of a hot-rolled sheet or during cold rolling performed in the production of the high-Al-content ferritic stainless steel foil. This results in difficulty in producing the foil and a reduction in yield. Moreover, hard oxide scale may be formed on a high-Al-content steel, which deteriorates the product quality in a descaling step in which pickling, polishing and the like are performed and increases the number of man-hours required.

To address the above-described problems, techniques have been proposed in which the production efficiency of a ferritic stainless steel foil used as a material of a catalyst carrier such as a metal honeycomb is improved by reducing the Al content in the foil to a minimum.

For example, Japanese Unexamined Patent Application Publication No. 7-213918 proposes a technique in which a metal honeycomb is formed by stacking a flat sheet and a corrugated sheet composed of a ferritic stainless steel foil alternately by diffusion bonding or liquid-phase bonding, the ferritic stainless steel foil having an Al content limited to an impurity level to 0.8% in terms of weight proportion and a Nb content of 0.1% to 0.6%. According to the technique proposed in Japanese Unexamined Patent Application Publication No. 7-213918, it is possible to improve the production efficiency of the ferritic stainless steel foil while achieving high oxidation resistance of the foil. Furthermore, it is possible to reduce the risk of formation of an alumina layer, which inhibits bonding when a heat treatment is performed at a high temperature during diffusion bonding or liquid-phase bonding. This enables a metal honeycomb to be produced at a low cost.

Japanese Unexamined Patent Application Publication No. 7-275715 proposes a technique in which a metal honeycomb is formed by stacking a flat sheet and a corrugated sheet composed of a ferritic stainless steel foil alternately by diffusion bonding or liquid-phase bonding, the ferritic stainless steel foil having an Al content limited to an impurity level to 0.8% in terms of weight proportion and a Mo content of 0.3% to 3%. According to the technique proposed in Japanese Unexamined Patent Application Publication No. 7-275715, it is possible to improve the production efficiency of the ferritic stainless steel foil while achieving high oxidation resistance of the foil and high resistance to sulfuric acid corrosion of the foil. In addition, it is possible to reduce the risk of formation of an alumina layer, which inhibits bonding when a heat treatment is performed at a high temperature during diffusion bonding or liquid-phase bonding. This enables a metal honeycomb to be produced at a low cost.

Japanese Unexamined Patent Application Publication No. 2004-307918 proposes a technique not related to a stainless steel foil but to an Al-containing ferritic stainless steel sheet having a thickness of about 0.6 to 1.5 mm used as a material of a catalyst-carrying member in which Al is added to a 18 mass % Cr steel such that the Al content in the steel is 1.0% to less than 3.0% by mass % and an oxide layer having an Al content of 15% or more and a thickness of 0.03 to 0.5 μm is formed on the surface of the steel sheet. According to the technique proposed in Japanese Unexamined Patent Application Publication No. 2004-307918, it is possible to produce an Al-containing heat-resistant ferritic stainless steel sheet having high workability and high oxidation resistance.

However, in the techniques proposed in Japanese Unexamined Patent Application Publication No. 7-213918 and Japanese Unexamined Patent Application Publication No. 7-275715, since the Al content in the ferritic stainless steel foil is reduced to 0.8% or less in terms of weight proportion, an Al oxide layer cannot be formed on the surface of the foil at high temperatures, but a Cr oxide layer is formed instead. If a Cr oxide layer is formed instead of an Al oxide layer, the oxidation resistance of the ferritic stainless steel foil may be degraded. In addition, if a Cr oxide layer is formed instead of an Al oxide layer, shape stability of the ferritic stainless steel foil at high temperatures and adhesion of the foil to an oxide layer (adhesion between a base iron and the oxide layer) may be degraded, which results in degradation of the adhesion of the foil to a catalyst coat (adhesion between the oxide layer and the wash coat).

If the oxide layer formed on the surface of the foil is composed of a Cr oxide layer only, the difference in thermal expansion coefficient between the oxide layer and a base iron becomes large compared to when the oxide layer is composed of an Al oxide layer. As a result, creep deformation may occur at a high temperature, which results in deformation of the foil and peeling of the oxide layer. In addition, when a catalytic material is applied onto the surface of such a ferritic stainless steel foil, the catalyst coat deposited on the surface of the ferritic stainless steel foil may become detached due to the deformation of the foil and peeling of the oxide layer that may occur at a high temperature. Thus, it is impossible to produce a metal honeycomb having the properties required for a catalyst carrier by the techniques proposed in Japanese Unexamined Patent Application Publication No. 7-213918 and Japanese Unexamined Patent Application Publication No. 7-275715.

The technique proposed in Japanese Unexamined Patent Application Publication No. 2004-307918 is directed to a cold-rolled steel sheet having a thickness of 1 mm. Thus, a foil material suitable as a material of a catalyst carrier is not always produced by applying this technique to a foil material. Since a foil material is considerably thin, the high-temperature strength of a base iron of a foil material is lower than that of a plate material, and a foil material is likely to be deformed at a high temperature. Therefore, when the technique proposed in Japanese Unexamined Patent Application Publication No. 2004-307918 is applied to a foil material, deformation may occur due to the difference in thermal expansion coefficient between the oxide layer and the base iron when Al is depleted and a Cr oxide layer begins to be formed while the foil material is oxidized at a high temperature because the proof stress of the base iron of the foil material is not sufficiently high.

Furthermore, when a stainless steel having an Al content of less than 3% is oxidized at a high temperature, an Al oxide layer is not formed on the surface of the stainless steel consistently, which significantly deteriorates adhesion to a catalyst coat. In general, a Cr oxide layer mainly composed of $Cr_2O_3$ is formed on the surface of a stainless steel having an Al content of less than 3% at a high temperature. However, $Cr_2O_3$ has poor adhesion to $\gamma$-$Al_2O_3$, which constitutes a wash coat (adhesion to a catalyst coat). Moreover, as described above, deformation may occur due to the difference in thermal expansion coefficient between the Cr oxide layer and the base iron, and peeling of the wash coat and the deposited catalyst is likely to occur.

As described above, degradation of oxidation resistance, shape stability at high temperatures, adhesion to an oxide layer, and adhesion to a catalyst coat, which may be caused due to formation of a Cr oxide layer, have been serious problems for a ferritic stainless steel foil in which the Al content is reduced to improve the production efficiency and workability of the foil.

It could therefore be helpful to provide a ferritic stainless steel foil suitable as a material of a catalyst carrier for exhaust gas purifying facilities (e.g., metal honeycomb) which are used at relatively low temperatures, that is, specifically, to improve the oxidation resistance of a low-Al ferritic stainless steel foil, the shape stability of the foil at high temperatures, the adhesion of the foil to an oxide layer, and the adhesion of the foil to a catalyst coat and to provide a ferritic stainless steel foil having good production efficiency.

SUMMARY

We Thus Provide:

[1] A ferritic stainless steel foil having a composition containing, by mass %, C: 0.050% or less, Si: 0.20% or less, Mn: 0.20% or less, P: 0.050% or less, S: 0.0050% or less, Cr: 10.5% or more and 20.0% or less, Ni: 0.01% or more and 1.00% or less, Al: more than 1.5% and less than 3.0%, Cu: 0.01% or more and 1.00% or less, N: 0.10% or less, and further contains one or more elements selected from Ti: 0.01% or more and 1.00% or less, Zr: 0.01% or more and 0.20% or less, and Hf: 0.01% or more and 0.20% or less, and the balance being Fe and inevitable impurities.

[2] The ferritic stainless steel foil described in [1], wherein the composition further contains, by mass %, one or more elements selected from Ca: 0.0010% or more and 0.0300% or less, Mg: 0.0015% or more and 0.0300% or less, and REM: 0.01% or more and 0.20% or less.

[3] The ferritic stainless steel foil described in [1] or [2], wherein the composition further contains, by mass %, one or more elements selected from Nb: 0.01% or more and 1.00% or less, Mo: 0.01% or more and 3.00% or less, W: 0.01% or more and 3.00% or less, and Co: 0.01% or more and 3.00% or less such that the total content of the one or more elements is 0.01% or more and 3.00% or less.

[4] The ferritic stainless steel foil described in any one of [1] to [3], the ferritic stainless steel foil being provided with a composite layer including an Al oxide layer and a Cr oxide layer, the composite layer being disposed on a surface of the ferritic stainless steel foil, the area fraction of the Al oxide layer being 20% or more.

A ferritic stainless steel foil suitable as a material of a catalyst carrier for exhaust gas purifying facilities which enables production efficiency to be improved and has high oxidation resistance, high shape stability at high temperatures, high adhesion to an oxide layer, and high adhesion to a catalyst coat can be produced.

The ferritic stainless steel foil can be suitably used as a material of a catalyst carrier for exhaust gas purifying facilities included in agricultural machinery such as a tractor and a combine-harvester and building machinery such as a bulldozer and a loading shovel, that is, off-load diesel-powered automobiles, or a material of a catalyst carrier for industrial exhaust gas purifying facilities. The ferritic stainless steel foil may also be used as a material of a catalyst carrier for diesel-powered automobiles and two-wheeled vehicles, a material of an external-cylinder member for such a catalyst carrier, a material of a member that exhausts gas for automobiles and two-wheeled vehicles, or a material of exhaust pipes for heating and combustion appliances. The applications of the ferritic stainless steel foil are not limited to the above-described applications.

REFERENCE SIGNS LIST

Figure 1:
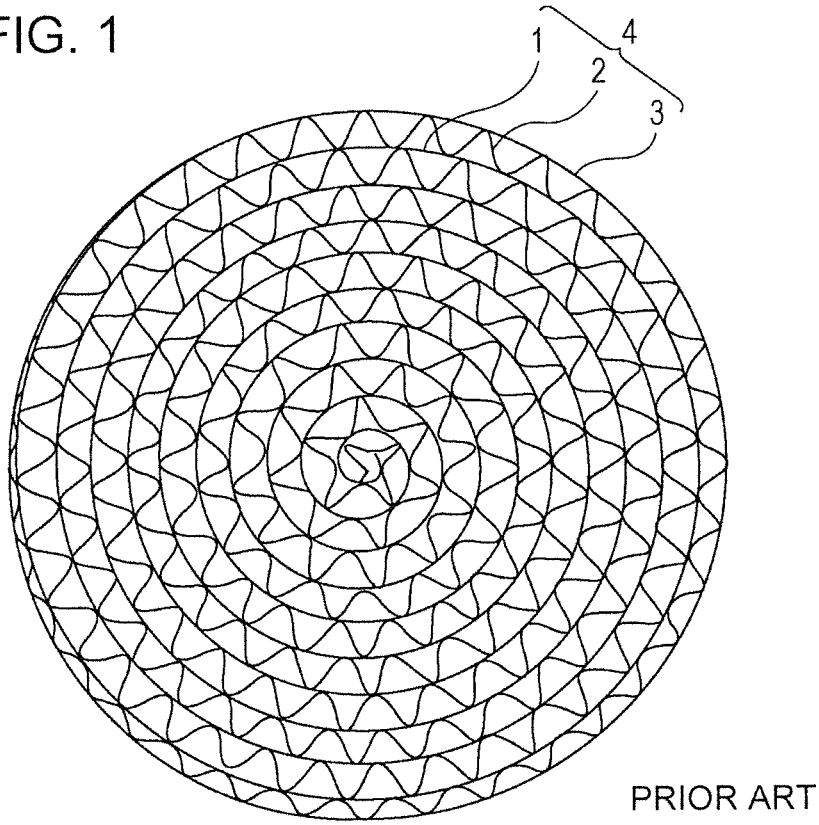
FIG. 1 is a diagram (cross-sectional view) illustrating an example of a metal honeycomb.

1: FLAT FOIL
2: CORRUGATED FOIL
3: EXTERNAL CYLINDER
4: METAL HONEYCOMB
5: BASE IRON
6: OXIDE LAYER
7: Al OXIDE LAYER
8: Cr OXIDE LAYER
9: $\gamma$-$Al_2O_3$ SERVING AS COATING

DETAILED DESCRIPTION

A catalyst carrier for exhaust gas purifying facilities included in diesel-powered automobiles, industrial machinery, and the like is exposed to an oxidizing atmosphere at 500° C. to 800° C. during operation. Accordingly, a ferritic stainless steel foil used as a material of the above-described catalyst carrier is required to have high oxidation resistance with which the catalyst carrier is capable of withstanding a long period of operation in an oxidizing atmosphere at 500° C. to 800° C. In addition, to prevent peeling of the catalyst from occurring during operation at high temperatures, it is desirable that the amount of deformation of the ferritic stainless steel foil used as a material of the above-described catalyst carrier which occurs when being used in an oxidizing atmosphere at 500° C. to 800° C. be small (shape stability). Furthermore, it is desirable that an oxide layer formed on the surface of the foil be less likely to be peeled at high temperatures (adhesion to an oxide layer). Moreover, the adhesion between a wash coat on which a catalyst is deposited and the surface of the foil is desirably high (adhesion to a catalyst coat).

We conducted extensive studies of various factors that may affect the oxidation resistance of a low-Al-content ferritic stainless steel foil having an Al content of less than 3%, the shape stability of the foil at high temperatures, the adhesion of the foil to an oxide layer, and the adhesion of the foil to a catalyst coat and, as a result, found the facts (1) to (4) below.

(1) Oxidation Resistance

A low-Al-content ferritic stainless steel foil having sufficiently high oxidation resistance in an oxidizing atmosphere at 500° C. to 800° C. can be produced by limiting the Mn content to 0.20% or less and the Al content to more than 1.5%. However, if the Al content is 3% or more, the toughness of a slab and the toughness of a hot-rolled sheet may be degraded, which results in failure to achieve good production efficiency. Thus, to achieve both high oxidation resistance and good production efficiency, the Al content in the low-Al-content ferritic stainless steel foil is limited to more than 1.5% to less than 3%.

(2) Shape Stability at High Temperatures

The amount of deformation of the foil which occurs at high temperatures (500° C. to 800° C.) can be reduced in an effective manner by increasing the high-temperature strength of the foil. Deformation of the foil results from a thermal stress caused due to the difference in thermal expansion coefficient between an oxide layer formed on the surface of the foil and a base iron. The amount of deformation of the foil can be reduced by increasing the high-temperature strength of the foil to a sufficiently high level at which the foil is capable of withstanding the thermal stress. The high-temperature strength of a low-Al-content ferritic stainless steel foil having an Al content of less than 3% can be increased in an effective manner by precipitation strengthening, which can be performed by adding Cu to the foil. Solute strengthening elements such as Nb, Mo, W, and Co may also be used in combination with Cu to further increase the high-temperature strength of the foil.

When a ferritic stainless steel foil having a Si content of 0.20% or less, an Al content of more than 1.5% and less than 3%, and a Cr content of 10.5% or more and 20.0% or less is maintained in an oxidizing atmosphere at 500° C. to 800° C., a composite layer of an Al oxide layer mainly composed of $Al_2O_3$ and a Cr oxide layer mainly composed of $Cr_2O_3$ is formed on the surface of the foil. When the composite layer is formed on the surface of the foil, the amount of deformation of the foil that occurs at high temperatures becomes small compared to when only a Cr oxide layer is formed all over the surface of the foil. This is presumably due to a reduction in the thermal stress caused by the Al oxide layer, which is partially formed on the surface of the foil. Since the difference in thermal expansion coefficient between the base iron of the ferritic stainless steel foil and the Cr oxide layer is considerably large, a large thermal stress is caused when only the Cr oxide layer is formed all over the surface of the foil, which may result in deformation of the foil, cracking in the oxide layer, and peeling of the oxide layer. In contrast, we believe that when the composite layer of an Al oxide layer and a Cr oxide layer is formed, the Al oxide layer, which has a lower thermal expansion coefficient than the Cr oxide layer, reduces the above-described thermal stress, which reduces the amount of deformation of the foil, the risk of cracking in the oxide layer, and the risk of peeling of the oxide layer.

(3) Adhesion to Oxide Layer

Increasing the high-temperature strength of the foil and thereby improving the shape stability of the foil as described in (2) also increases adhesion of the foil to the oxide layer. One of the factors that lead to peeling of the oxide layer is cracks that may be formed when deformation of the foil occurs at a high temperature and voids that may be formed at the interface between the oxide layer and the base iron. If such cracks and voids are present, the base iron, which is not protected to a sufficient degree, is exposed at the surface of the foil, and the exposed portion of the base iron is oxidized to a considerable degree, which may result in peeling of the oxide layer. Thus, limiting the composition of the ferritic stainless steel foil to be the above-described optimum composition and thereby increasing the high-temperature strength of the foil enables the shape of the foil to be stabilized at high temperatures and also increases the adhesion of the foil to the oxide layer.

(4) Adhesion to Catalyst Coat

The shape stability of the foil at high temperatures and the adhesion of the foil to the oxide layer are improved in the above-described manner. As a result, adhesion of the ferritic stainless steel foil to a catalyst coat can also be increased.

Furthermore, adhesion of the foil to a catalyst coat can be increased in an effective manner by forming an adequate oxide layer on the surface of the foil prior to formation of a catalyst coat. When a low-Al-content ferritic stainless steel foil having an Al content of more than 1.5% and less than 3% is subjected to a heat treatment in an oxidizing atmosphere at 800° C. or more and 1100° C. or less (hereinafter, this heat treatment is referred to as "oxidation treatment"), a composite layer of an Al oxide layer mainly composed of $Al_2O_3$ and a Cr oxide layer mainly composed of $Cr_2O_3$ is formed on the surface of the foil. The area fraction of the Al oxide layer is 20% or more. When such a composite layer is formed on the surface of the foil, the adhesion of the foil to a catalyst coat is markedly increased compared to when an oxide layer is not formed on the surface of the foil. This is presumably because the Al oxide layer partially formed in the above-described composite layer has an acicular shape or a blade-like shape and thereby produces an anchoring effect, which increases the adhesion of the foil to a wash coat.

When the low-Al-content ferritic stainless steel foil having an Al content of more than 1.5% and less than 3% is subjected to, prior to the above-described oxidation treatment, a heat treatment in which the foil is maintained at 800° C. or more and 1250° C. or less for a predetermined period of time in a reducing atmosphere or a vacuum (hereinafter, this heat treatment is referred to as "heat pretreatment"), growth of the Al-oxide part of the composite layer is facilitated, which further increases the adhesion of the ferritic stainless steel foil to a catalyst coat.

Our foils are specifically described below.

Our ferritic stainless steel foil has a composition containing, by mass %, C: 0.050% or less, Si: 0.20% or less, Mn: 0.20% or less, P: 0.050% or less, S: 0.0050% or less, Cr: 10.5% or more and 20.0% or less, Ni: 0.01% or more and 1.00% or less, Al: more than 1.5% and less than 3.0%, Cu: 0.01% or more and 1.00% or less, N: 0.10% or less, and further contains one or more elements selected from Ti: 0.01% or more and 1.00% or less, Zr: 0.01% or more and 0.20% or less, and Hf: 0.01% or more and 0.20% or less, and the balance being Fe and inevitable impurities. Controlling the composition of the ferritic stainless steel foil as described above enables a ferritic stainless steel foil having a high-temperature oxidation characteristic such that a composite layer of an Al oxide layer and a Cr oxide layer is formed on the surface of the foil in a high-temperature oxidizing atmosphere to be produced.

The ferritic stainless steel foil is a foil material composed of a ferritic stainless steel. Specifically, the ferritic stainless steel foil is a foil material principally having a thickness of 200 μm or less and different from a sheet material generally having a thickness of more than 200 μm to 3 mm or less.

The reasons for limiting the composition of the ferritic stainless steel foil are described below. Note that, when referring to a composition, "%" always denotes "mass %" unless otherwise specified.

C: 0.050% or Less

If the C content exceeds 0.050%, the oxidation resistance of the ferritic stainless steel foil may be degraded. Furthermore, if the C content exceeds 0.050%, the toughness of the ferritic stainless steel may be degraded, which deteriorates the production efficiency of the foil. Thus, the C content is limited to 0.050% or less and is preferably 0.020% or less. However, setting the C content to less than 0.003% may increase the time required to refine and is, therefore, undesirable from a manufacturing viewpoint.

Si: 0.20% or Less

If the Si content exceeds 0.20%, a Si oxide layer may be formed between the oxide layer and the base iron, which inhibits formation of an Al oxide layer. As a result, an oxide layer composed of a Cr oxide layer only may disadvantageously be formed instead of a composite oxide layer of a Cr oxide layer and an Al oxide layer. Thus, the Si content is limited to 0.20% or less, is preferably 0.15% or less, and is further preferably less than 0.10%. However, if the Si content is less than 0.03%, it is impossible to perform refining by an ordinary method and the time and cost required for refining may be increased. Thus, setting the Si content to less than 0.03% is undesirable from a manufacturing viewpoint.

Mn: 0.20% or Less

If the Mn content exceeds 0.20%, the oxidation resistance of the ferritic stainless steel foil may be degraded. Thus, the Mn content is limited to 0.20% or less, is preferably 0.15% or less, and is further preferably less than 0.10%. However, if the Mn content is less than 0.03%, it is impossible to perform refining by an ordinary method and the time and cost required for refining may be increased. Thus, setting the Mn content to less than 0.03% is undesirable from a manufacturing viewpoint.

P: 0.050% or Less

If the P content exceeds 0.050%, the adhesion between an oxide layer formed on the surface of the ferritic stainless steel foil and the base iron (adhesion to an oxide layer) may be reduced. Furthermore, the oxidation resistance of the ferritic stainless steel foil may also be degraded. Thus, the P content is limited to 0.050% or less and is preferably 0.030% or less.

S: 0.0050% or Less

If the S content exceeds 0.0050%, the adhesion between an oxide layer formed on the surface of the ferritic stainless steel foil and the base iron (adhesion to an oxide layer) may be reduced. Furthermore, the oxidation resistance of the ferritic stainless steel foil may also be degraded. Thus, the S content is limited to 0.0050% or less, is preferably 0.0030% or less, and is more preferably 0.0010% or less.

Cr: 10.5% or More and 20.0% or Less

Cr is an essential element that enhances the oxidation resistance of the ferritic stainless steel foil and increases the strength of the foil. It is necessary to limit the Cr content to 10.5% or more to obtain such an advantageous effect. However, if the Cr content exceeds 20.0%, the toughnesses of a slab, a hot-rolled sheet, a cold-rolled sheet, and the like prepared from the ferritic stainless steel may be degraded, which results in failure to achieve good production efficiency. Thus, the Cr content is limited to 10.5% or more and 20.0% or less. When consideration is given to the balance between the production cost of the ferritic stainless steel foil and the properties of the foil at high temperatures, the Cr content is preferably 10.5% or more and 18.0% or less, is more preferably 13.5% or more and 16.0% or less, and is further preferably 14.5% or more and 15.5% or less.

Ni: 0.01% or More and 1.00% or Less

Ni enhances the brazeability of the ferritic stainless steel foil which is required when the ferritic stainless steel foil is formed into a desired catalyst-carrier structure. Thus, the Ni content is limited to 0.01% or more. However, since Ni is an austenite-stabilization element, if the Ni content exceeds 1.00%, the austenite microstructure may be formed when Al and Cr included in the foil are consumed due to oxidation while an oxidation treatment is performed at a high temperature. If the austenite microstructure is formed, thermal expansion coefficient is increased, which may cause defects such as necking and rupturing of the foil to occur. Thus, the Ni content is limited to 0.01% or more and 1.00% or less, is preferably 0.05% or more and 0.50% or less, and is more preferably 0.10% or more and 0.20% or less.

Al: More than 1.5% and Less than 3.0%

Al is the most important element in our foils. When the Al content exceeds 1.5%, a composite layer of an Al oxide layer and a Cr oxide layer is formed as an oxide layer on the surface of the ferritic stainless steel foil when the foil is used at a high temperature, which enhances the oxidation resistance of the ferritic stainless steel foil, the shape stability of the foil at high temperatures, and the adhesion of the foil to a catalyst coat. In addition, when the Al content exceeds 1.5%, a composite layer of an Al oxide layer mainly composed of $Al_2O_3$ and a Cr oxide layer mainly composed of $Cr_2O_3$, the area fraction of the Al oxide layer being 20% or more on the surface of the foil, can be formed by performing an oxidation treatment prior to deposition of a catalyst coat. This increases the adhesion between the ferritic stainless steel foil and a wash coat (adhesion to a catalyst coat).

However, if the Al content is 3.0% or more, the toughness of a material of the ferritic stainless steel foil, that is, a hot-rolled sheet may be degraded, which deteriorates the production efficiency of the foil. Moreover, if the Al content is 3.0% or more, oxide scale formed on the above-described hot-rolled sheet or the like becomes rigid, and the difficulty in removing the scale in a pickling or polishing process may be increased, which deteriorates the production efficiency of the foil. Thus, the Al content is limited to more than 1.5% and less than 3.0%. When consideration is given to the balance between the production efficiency of the ferritic stainless steel foil and the oxidation resistance of the foil, the Al content is preferably more than 1.8% and less than 2.5%.

Cu: 0.01% or More and 1.00% or Less

Cu is an element that increases the high-temperature strength of the ferritic stainless steel foil. Adding Cu to the foil causes fine precipitates to be formed, which increases the strength of the foil. This reduces the amount of high-temperature creep deformation that occurs due to the difference in thermal expansion coefficient between an oxide layer formed on the surface of the foil and the base iron. The reduction in the amount of high-temperature creep deformation results in enhancement of the shape stability of the ferritic stainless steel foil at high temperatures. Accordingly, the adhesion of the foil to an oxide layer and the adhesion of the foil to a catalyst coat are increased.

The Cu content is limited to 0.01% or more to obtain the above described advantageous effects. However, if the Cu content exceeds 1.00%, the oxidation resistance of the ferritic stainless steel foil may be degraded. In addition, the difficulty in working the foil may be increased, which increases the production cost. Thus, the Cu content is limited to 0.01% or more and 1.00% or less. When consideration is given to the shape stability of the ferritic stainless steel foil and cost reduction, the Cu content is preferably 0.05% or more and 0.80% or less and is more preferably 0.10% or more and 0.50% or less.

N: 0.10% or Less

If the N content exceeds 0.10%, the toughness of the ferritic stainless steel may be degraded, which results in difficulty in producing the foil. Thus, the N content is limited to 0.10% or less, is preferably 0.05% or less, and further preferably 0.02% or less. However, setting the N content to less than 0.003% may increase the time required for refining and is therefore undesirable from a manufacturing viewpoint.

One or More Elements Selected from Ti: 0.01% or More and 1.00% or Less, Zr: 0.01% or More and 0.20% or Less, and Hf: 0.01% or More and 0.20% or Less The ferritic stainless steel foil contains one or more elements selected from Ti, Zr, and Hf to enhance the toughness, oxidation resistance, and production efficiency of the foil.

Ti: 0.01% or More and 1.00% or Less

Ti is an element that stabilizes C and N contained in a steel and thereby enhances the production efficiency and corrosion resistance of the ferritic stainless steel. Ti also increases adhesion between an oxide layer formed on the surface of the ferritic stainless steel foil and the base iron. Such advantageous effects can be obtained by limiting the Ti content to 0.01% or more. However, since Ti is easily oxidized, if the Ti content exceeds 1.00%, a large amount of Ti oxide may be mixed in the oxide layer formed on the surface of the ferritic stainless steel foil. If a large amount of Ti oxide is mixed in the oxide layer as described above, the oxidation resistance of the ferritic stainless steel foil may be degraded. Furthermore, a Ti oxide layer may be formed when a heat treatment is performed at a high temperature during brazing, which significantly deteriorates brazeability. Thus, when the ferritic stainless steel foil contains Ti, the Ti content is preferably 0.01% or more and 1.00% or less, is more preferably 0.05% or more and 0.50% or less, and is further preferably 0.10 or more and 0.30% or less.

Zr: 0.01% or More and 0.20% or Less

Zr combines with C and N contained in a steel and thereby enhances the toughness of the ferritic stainless steel, which facilitates production of the foil. In addition, Zr concentrates at the crystal grain boundaries in an oxide layer formed on the surface of the ferritic stainless steel foil, which enhances the oxidation resistance of the foil, increases the high-temperature strength of the foil, and enhances the shape stability of the foil. Such advantageous effects may be obtained by limiting the Zr content to 0.01% or more. However, if the Zr content exceeds 0.20%, Zr may form an intermetallic compound together with Fe or the like, which deteriorates the oxidation resistance of the ferritic stainless steel foil. Thus, when the ferritic stainless steel foil contains Zr, the Zr content is preferably 0.01% or more and 0.20% or less, is more preferably 0.01% or more and 0.15% or less, and further preferably 0.03% or more to 0.05% or less.

Hf: 0.01% or More and 0.20% or Less

Hf increases adhesion between an Al oxide layer formed on the surface of the ferritic stainless steel foil and the base iron. Hf also reduces the growth rate of the Al oxide layer and thereby limits a reduction in the Al content in the steel, which enhances the oxidation resistance of the ferritic stainless steel foil. The Hf content is preferably 0.01% or more to obtain such advantageous effects. However, if the Hf content exceeds 0.20%, Hf may be mixed in the above-described Al oxide layer in the form of $HfO_2$ and may serve as a path through which oxygen is diffused. As a result, on the contrary, oxidation may be accelerated and the rate of reduction in the Al content in the steel may be increased. Thus, when the ferritic stainless steel foil contains Hf, the Hf content is preferably 0.01% or more and 0.20% or less, is more preferably 0.02% or more and 0.10% or less, and is further preferably 0.03% or more and 0.05% or less.

The above-described elements are the fundamental constituents of the ferritic stainless steel foil. The ferritic stainless steel foil may contain the following elements as needed in addition to the above-described fundamental constituents.

One or More Elements Selected from Ca: 0.0010% or More and 0.0300% or Less, Mg: 0.0015% or More and 0.0300% or Less, and REM: 0.01% or More and 0.20% or Less The ferritic stainless steel foil may contain one or more elements selected from Ca, Mg, and REM primarily to increase the adhesion of the ferritic stainless steel foil to an oxide layer and enhance the oxidation resistance of the foil.

Ca: 0.0010% or More and 0.0300% or Less

Ca increases the adhesion between an Al oxide layer formed on the surface of the ferritic stainless steel foil and the base iron. The Ca content is preferably 0.0010% or more to obtain such an advantageous effect. However, if the Ca content exceeds 0.0300%, the toughness of the ferritic stainless steel and the oxidation resistance of the ferritic stainless steel foil may be degraded. Thus, the Ca content is preferably 0.0010% or more and 0.0300% or less and is more preferably 0.0020% or more and 0.0100% or less.

Mg: 0.0015% or More and 0.0300% or Less

Similarly to Ca, Mg increases the adhesion between an Al oxide layer formed on the surface of the ferritic stainless steel foil and the base iron. The Mg content is preferably 0.0015% or more to obtain such an advantageous effect. However, if the Mg content exceeds 0.0300%, the toughness of the ferritic stainless steel and the oxidation resistance of the ferritic stainless steel foil may be degraded. Thus, the Mg content is preferably 0.0015% or more and 0.0300% or less and is more preferably 0.0020% or more and 0.0100% or less.

REM: 0.01% or More and 0.20% or Less

REMs refer to Sc, Y, and lanthanide-series elements (elements of atomic numbers 57 to 71 such as La, Ce, Pr, Nd, and Sm). The "REM content" herein refers to the total content of these elements. In general, REMs increase the adhesion of the ferritic stainless steel foil to an oxide layer formed on the surface of the foil, which markedly enhances the peeling resistance of the oxide layer. Such an advantageous effect can be obtained by limiting the REM content to 0.01% or more. However, if the REM content exceeds 0.20%, these elements may concentrate at the crystal grain boundaries during production of the ferritic stainless steel foil. Such elements become melted when heated to a high temperature, which causes defects to occur on the surface of a material of the foil, that is, a hot-rolled sheet. Thus, the REM content is preferably 0.01% or more and 0.20% or less and is more preferably 0.03% or more and 0.10% or less.

One or More Elements Selected from Nb: 0.01% or More and 1.00% or Less, Mo: 0.01% or More and 3.00% or Less, W: 0.01% or More and 3.00% or Less, and Co: 0.01% or More and 3.00% or Less: 0.01% or More and 3.00% or Less in Total The ferritic stainless steel foil may contain one or more elements selected from Nb, Mo, W, and Co primarily to increase the high-temperature strength of the ferritic stainless steel foil such that the total content of the selected elements is 0.01% or more and 3.00% or less.

Nb: 0.01% or More and 1.00% or Less

Nb increases the high-temperature strength of the ferritic stainless steel foil, which enhances the shape stability of the foil at high temperatures and increases the adhesion of the foil to an oxide layer. Such an advantageous effect can be obtained by limiting the Nb content to 0.01% or more. However, if the Nb content exceeds 1.00%, the toughness of the ferritic stainless steel may be degraded, which results in difficulty in producing the foil. Thus, when the ferritic stainless steel foil contains Nb, the Nb content is preferably 0.01% or more and 1.00% or less and is more preferably 0.10% or more and 0.70% or less. When consideration is given to the balance between the high-temperature strength of the ferritic stainless steel foil and the production efficiency of the foil, the Nb content is further preferably 0.30% or more and 0.60% or less.

Mo: 0.01% or More and 3.00% or Less

W: 0.01% or More and 3.00% or Less

Co: 0.01% or More and 3.00% or Less

Since Mo, W, and Co each increase the high-temperature strength of the ferritic stainless steel foil, using a ferritic stainless steel foil containing Mo, W, and Co as a material of a catalyst carrier for exhaust gas purifying facilities increases the service life of the catalyst carrier. These elements also stabilize an oxide layer formed on the surface of the ferritic stainless steel foil, which enhances salt corrosion resistance. Such advantageous effects can be obtained by limiting each of the Mo, W, and Co contents to 0.01% or more. However, if the Mo, W, or Co content exceeds 3.00%, the toughness of the ferritic stainless steel may be degraded, which results in difficulty in producing the foil. Thus, when the ferritic stainless steel foil contains Mo, W, and Co, the Mo, W, and Co contents are each preferably 0.01% or more and 3.00% or less and are each more preferably 0.1% or more and 2.50% or less.

When the ferritic stainless steel foil contains one or more elements selected from Nb, Mo, W, and Co, the total content of the selected elements is preferably 3.00% or less. If the total content of the selected elements exceeds 3.00%, the toughness of the ferritic stainless steel may be significantly degraded, which results in difficulty in producing the foil. The total content of the selected elements is more preferably 2.50% or less.

Elements contained in the ferritic stainless steel foil which are other than the above-described elements (balance) are Fe and inevitable impurities. Examples of the inevitable impurities include Zn, Sn, and V. The contents of these elements are each preferably 0.1% or less.

A heat treatment in which a composite layer of an Al oxide layer and a Cr oxide layer is formed on the surface of the ferritic stainless steel foil is described below. While the ferritic stainless steel foil has high oxidation resistance, high shape stability at high temperatures, high adhesion to an oxide layer, and sufficiently high adhesion to a catalyst coat, a composite layer of an Al oxide layer and a Cr oxide layer (area fraction of Al oxide layer: 20% or more) may optionally be formed on the surface of the ferritic stainless steel foil to further increase the adhesion of the foil to a catalyst coat.

When the ferritic stainless steel foil is subjected to an oxidation treatment in which the foil is maintained in a high-temperature oxidizing atmosphere at 800° C. or more and 1100° C. or less for 1 minute or more to 25 hours or less, a composite layer of an Al oxide layer and a Cr oxide layer in which the area fraction of the Al oxide layer is 20% or more, which is suitable for a catalyst carrier for exhaust gas purifying facilities, is formed on the surface of the foil. The "high-temperature oxidizing atmosphere" herein refers to an atmosphere having an oxygen concentration of about 0.5 vol % or more.

The growth of the Al oxide during the oxidation treatment, which is included in the composite layer, can be facilitated when the ferritic stainless steel foil is subjected to, prior to the above-described heat treatment (oxidation treatment) performed in an oxidizing atmosphere, a heat pretreatment in which the foil is heated to a temperature of 800° C. or more and 1250° C. or less in a reducing atmosphere or in a vacuum of 1.0×10 Pa or less and $1.0\times10^{-5}$ Pa or more and subsequently maintained in the above-described temperature range for a residence time of 10 seconds or more and 2 hours or less. Therefore, when the ferritic stainless steel foil is subjected to the oxidation treatment subsequent to the above-described heat pretreatment, a ferritic stainless steel foil on which a composite layer of an Al oxide layer and a Cr oxide layer is formed and which has markedly high adhesion to a catalyst coat may be produced. The "reducing atmosphere" herein refers to an atmosphere having a dew point of −10° C. or less.

The oxide layer formed on the surface of the ferritic stainless steel foil is observed in the following manner.

Figure 2:
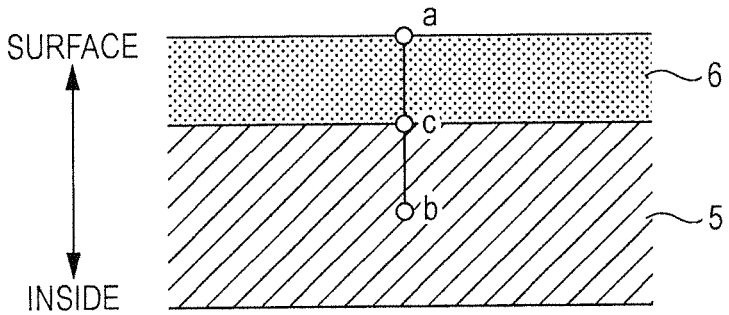
FIG. 2 is a schematic diagram illustrating an example of a cross section of the surface of a stainless steel foil on which an oxide layer is formed.

FIG. 2 is a schematic diagram illustrating a cross section of the surface of the ferritic stainless steel foil, in which an oxide layer 6 is formed on the surface layer of a base iron 5. The ferritic stainless steel foil on which an oxide layer is formed is cut in a direction perpendicular to the surface of the foil and embedded in a resin or the like such that the cut surface is exposed. Then, the cut surface is polished. Subsequently, a line analysis (oxygen concentration analysis) is conducted, for example, from the point a, which is the top surface of the foil, to the point b, which is located inside the foil (base-iron part), using a known component analysis system such as an electron probe micro analyzer (EPMA). When an oxide layer is present, the oxygen detection intensity increases with the progress of the line analysis starting from the point a and, after the maximal oxygen detection intensity is reached, decreases toward the point c, which is located at the interface between the oxide layer and the base iron. The oxygen detection intensity keeps decreasing beyond the point c with the progress of the line analysis and becomes substantially constant in the vicinity of the point b, which is located inside the foil (base-iron part).

The point b, at which the line analysis is terminated, is positioned at a sufficient distance from the point c toward the inside of the foil (e.g., distance between the points a and b: thickness of foil including oxide layer×0.5). The point at which the oxygen detection intensity is equal to "(detection intensity at maximal point+detection intensity at point b)×0.5" is believed to be the point c, and the portion of the foil between the points a and c, in which the oxygen level is higher than inside the foil, is considered to be the oxide layer 6. The portion of the foil which extends from the point c toward the inside of the foil is considered to be the base iron 5.

Whether the oxide layer formed on the surface of the ferritic stainless steel foil is the composite layer (composite layer of an Al oxide layer and a Cr oxide layer) or not can be confirmed by, for example, identifying the type of the oxide layer by analyzing the surface of the ferritic stainless steel foil using a known system such as an X-ray diffraction system.

The area fraction of the Al oxide layer included in the top surface of the composite layer can be measured in the following manner.

The type of the oxide layer formed on the surface of the ferritic stainless steel foil is identified by the above-described method to confirm that the oxide layer is a composite layer of an Al oxide layer and a Cr oxide layer. Then, an image of the oxide layer formed on the surface of the ferritic stainless steel foil is taken using a scanning electron microscope (SEM) or the like. The positions and shapes (on the image) of the Al oxide layer and the Cr oxide layer are determined using, as needed, a component analysis of the oxide layer (composite layer) conducted by energy dispersive X-ray spectroscopy (EDX), electron probe microanalysis (EPMA) or the like. The area fraction of the Al oxide layer in the surface of the composite layer can be determined by calculating the fraction of the portions of the image in which the Al oxide layer is formed in terms of area fraction. For example, when the observed oxide layer is a composite layer including two types of layers, that is, an Al oxide layer and a Cr oxide layer, the different surface layers included in the image are converted to binary, and the area fraction of the Al oxide layer can be calculated using a commercially available image-processing software or the like. The area of the region in which the image of the oxide layer formed on the surface of the ferritic stainless steel foil is taken is preferably as large as possible such that the shape of the oxide layer can be determined. A specific example is described below.

Figure 3:
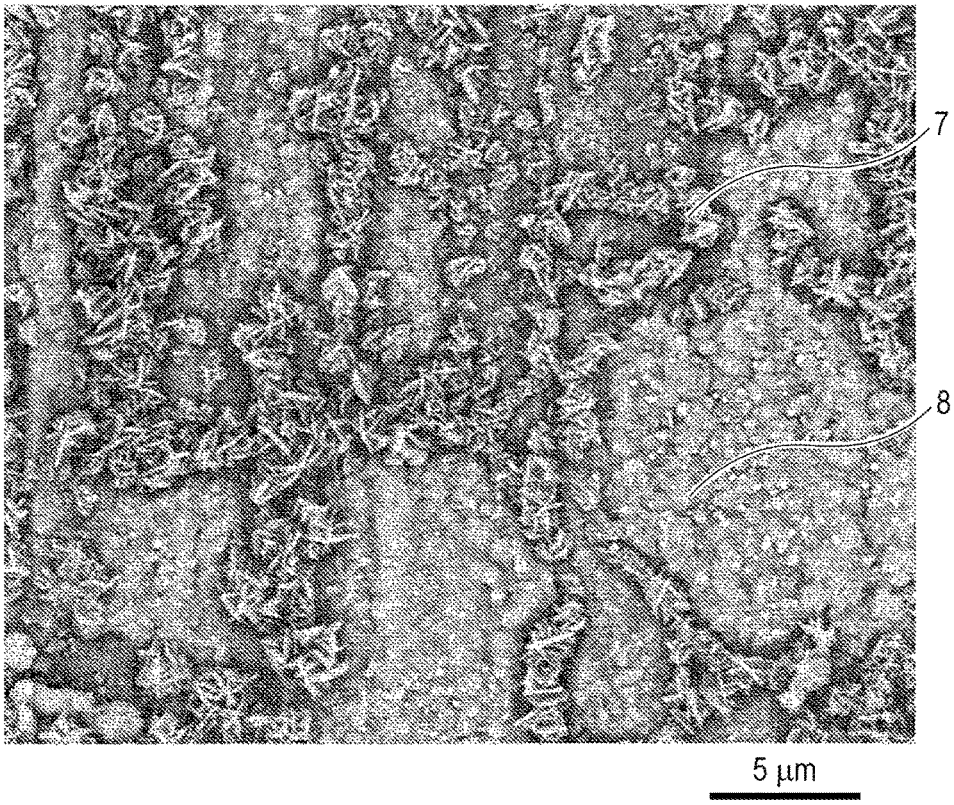
FIG. 3 is a diagram illustrating an example of a SEM observation of a composite layer of an Al oxide layer and a Cr oxide layer formed on the surface of a stainless steel foil.

FIG. 3 illustrates the result of a SEM observation (SEM image) of the surface of a specimen taken from the ferritic stainless steel foil, which had been subjected to a heat pretreatment in which the specimen was maintained at 1200° C. in vacuum for 30 minutes and subsequently subjected to an oxidation treatment in which the specimen was maintained at 900° C. in the air for 5 hours ("specimen A" in Examples below). It was confirmed from the SEM image illustrated in FIG. 3 that two oxide layers having different shapes (the layer 7 that had an acicular shape and the layer 8 that did not have an acicular shape) were present. The results of an X-ray diffraction analysis of the specimen after the oxidation treatment confirmed that the oxide layer formed on the surface of the specimen was a composite layer including two types of oxides, that is, $Al_2O_3$ and $Cr_2O_3$.

A composition analysis of the two oxide layers having different shapes which are present in the SEM image illustrated in FIG. 3 was conducted by EDX, EPMA, or the like. As a result, we found that the layer 7 having an acicular shape was an $Al_2O_3$ layer, the other layer 8 was a $Cr_2O_3$ layer, and the oxide layer formed on the surface of the specimen after the oxidation treatment was a composite layer of an Al oxide layer and a Cr oxide layer. The different surface layers included in the SEM image were converted to binary, and the area fraction of the Al oxide layer was calculated using a commercially available image-processing software (e.g., "Photoshop" produced by Adobe Systems Incorporated).

The area fraction of the $Al_2O_3$ layer (Al oxide layer, layer 7 in FIG. 3) in the top surface of the oxide layer illustrated in FIG. 3 (composite layer of an $Al_2O_3$ layer and a $Cr_2O_3$ layer), which was calculated by the above-described method, was 43%. The same analysis was conducted in three fields of view, and the average thereof was considered to be the area fraction of the Al oxide layer.

A preferred method of producing the ferritic stainless steel foil is described below.

The ferritic stainless steel foil can be produced using ordinary stainless steel production equipment. For example, a stainless steel having the above-described composition is refined in a steel converter, an electric furnace, or the like, subjected to secondary refining by VOD (vacuum oxygen decarburization) or AOD (argon-oxygen decarburization), and subsequently formed into a steel slab having a thickness of about 200 to 300 mm by ingot casting-slabbing or continuous casting. The cast slab is charged into a heating furnace, heated to 1150° C. to 1250° C., and subsequently hot-rolled. Thus, a hot-rolled sheet having a thickness of about 2 to 4 mm is prepared. Optionally, the hot-rolled sheet may be annealed at 800° C. to 1050° C. Scale is removed from the surface of the hot-rolled sheet by shotblasting, pickling, mechanical polishing or the like. Subsequently, cold rolling and annealing are repeated plural times to form a stainless steel foil having a thickness of 200 μm or less.

Processing strain that occurs during cold rolling affects the aggregate structure after recrystallization, which facilitates the growth of the Al oxide layer included in the composite layer formed on the surface of the ferritic stainless steel foil. Thus, when cold rolling and annealing are repeated plural times to form a foil, the rolling reduction ratio in the final cold rolling, in which the annealed intermediate material is formed into a foil having a desired thickness, is preferably 50% or more and 95% or less to produce a foil in which a large amount of processing strain is applied. The above-described annealing treatment is preferably performed by maintaining 700° C. to 1050° C. in a reducing atmosphere for 30 seconds to 5 minutes.

The thickness of the foil may be controlled depending on the application of the foil. For example, when the foil is used as a material of a catalyst carrier for exhaust gas purifying facilities which is particularly required to have high vibration resistance and high durability, the thickness of the foil is preferably about more than 50 μm and 200 μm or less. When the foil is used as a material of a catalyst carrier for exhaust gas purifying facilities which is particularly required to have a high cell density and a high back pressure, the thickness of the foil is preferably about 25 μm or more and 50 μm or less.

A method of forming a composite layer of an Al oxide layer and a Cr oxide layer (area fraction of Al oxide layer: 20% or more) on the surface of the ferritic stainless steel foil is described below.

When the ferritic stainless steel foil is exposed to a high temperature in an oxidizing atmosphere, a composite layer of an Al oxide layer and a Cr oxide layer is formed on the surface of the foil, which increases the adhesion of the foil to a catalyst coat. To form the composite layer of an Al oxide layer and a Cr oxide layer (area fraction of the Al oxide layer: 20% or more) on the surface of the ferritic stainless steel foil, it is preferable to heat the foil to a temperature of 800° C. or more to 1100° C. or less in an oxidizing atmosphere having an oxygen concentration of 0.5 vol % or more and subsequently perform a heat treatment (oxidation treatment) in which the foil is maintained in the above-described temperature range for a residence time of 1 minute or more to 25 hours or less. The above-described oxygen concentration is more preferably 5 vol % or more and is further preferably 15 vol % or more and 21 vol % or less.

If the foil is heated to less than 800° C. in the above-described heat treatment performed in an oxidizing atmosphere (oxidation treatment), it may be impossible to form an oxide layer in which the area fraction of the Al oxide layer is 20% or more, which is necessary to increase adhesion of the foil to a catalyst coat. In another case, it may be impossible to form an oxide layer having a sufficiently large thickness. On the other hand, if the foil is heated to more than 1100° C., the size of the crystal grains of the foil may be increased, which makes the foil brittle. Thus, in the above-described heat treatment (oxidation treatment), the foil is heated to 800° C. or more and 1100° C. or less and is preferably heated to 850° C. or more and 950° C. or less. If the foil is maintained at 800° C. or more and 1100° C. or less for a residence time of less than 1 minute, it is impossible to form an oxide layer having a thickness large enough to increase the adhesion of the foil to a catalyst coat. On the other hand, if the above-described residence time exceeds 25 hours, the oxide layer may become brittle and likely to be peeled. Thus, the above-described residence time is preferably 1 minute or more and 25 hours or less and is more preferably 1 hour or more and 15 hours or less.

To further increase adhesion of the ferritic stainless steel foil to a catalyst coat, it is preferable to perform, prior to the above-described heat treatment (oxidation treatment) performed in an oxidizing atmosphere, a heat pretreatment in which the foil is heated to a temperature of 800° C. or more and 1250° C. or less in a reducing atmosphere or in a vacuum of $1.0\times10$ Pa or less and $1.0\times10^{-5}$ Pa or more and subsequently maintained in the above-described temperature range for a residence time of 10 seconds or more and 2 hours or less. The heat pretreatment facilitates the growth of the Al-based oxide layer included in the composite layer and thereby increases the area fraction of the Al oxide layer, which markedly increases the adhesion of the foil to a catalyst coat.

Examples of an atmosphere gas used in the heat pretreatment performed in a reducing atmosphere include a $N_2$ gas and a $H_2$ gas. If the foil is heated to less than 800° C. or more than 1250° C. in the above-described heat pretreatment performed in a reducing atmosphere or in a vacuum of $1.0\times10$ Pa or less and $1.0\times10^{-5}$ Pa or more, it may be impossible to promote formation of the Al oxide layer to a sufficient degree. Thus, in the above-described heat pretreatment, the foil is heated to 800° C. or more and 1250° C. or less. If the residence time for which the foil is maintained at 800° C. or more and 1250° C. or less is less than 10 seconds, it may be impossible to promote formation of the Al oxide layer to a sufficient degree. On the other hand, if the above-described residence time exceeds 2 hours, it may be impossible to further promote formation of the Al oxide layer. In addition, the yield in the production process may be degraded. Thus, the above-described residence time is preferably 10 seconds or more and 2 hours or less and is more preferably 60 seconds or more and 1 hour or less. If the degree of vacuum is more than $1.0\times10$ Pa or less than $1.0\times10^{-5}$ Pa, it may be impossible to promote formation of the Al oxide layer. Thus, the degree of vacuum is limited to $1.0\times10$ Pa or less and $1.0\times10^{-5}$ Pa or more.

When the ferritic stainless steel foil is subjected to the heat treatment (oxidation treatment) in an oxidizing atmosphere as described above, the composite layer (composite layer of an Al oxide layer and a Cr oxide layer) is formed on the foil. When the ferritic stainless steel foil is used as a material of a catalyst carrier for exhaust gas purifying facilities, the thickness of the composite layer formed on the surface of the foil is preferably more than 0.5 μm and 10.0 μm or less, is more preferably 0.7 μm or more and 5.0 μm or less, and is further preferably 1.0 μm or more and 3.0 μm or less per side of the foil. The thickness of the composite layer can be controlled to be a desired thickness by changing the residence time for which the foil is maintained at 800° C. or more and 1100° C. or less in the heat treatment (oxidation treatment) performed in an oxidizing atmosphere.

To produce a catalyst carrier for exhaust gas purifying facilities using the ferritic stainless steel foil, the following method is preferably employed.

A catalyst carrier for exhaust gas purifying facilities is produced by forming a material, that is, the ferritic stainless steel foil, into a predetermined shape and performing bonding. For example, the metal honeycomb illustrated in FIG. 1 can be produced by stacking a flat foil 1 and a corrugated foil 2 composed of the ferritic stainless steel foil, winding the resulting product into a roll shape, and fixing the periphery of the wound product in place with an external cylinder 3. The portion at which the flat foil 1 and the corrugated foil 2 are brought into contact with each other and the portion at which the corrugated foil 2 and the external cylinder 3 are brought into contact with each other are bonded by brazing, diffusion bonding, or the like.

To produce a catalyst carrier for exhaust gas purifying facilities using the ferritic stainless steel foil, the production process preferably includes a step in which the above-described oxidation treatment is performed. The step in which the oxidation treatment is performed may be conducted before or after the ferritic stainless steel foil is formed into a predetermined shape (e.g., honeycomb shape) and bonding is performed. That is, either of a ferritic stainless steel foil that has not yet been formed into a predetermined shape or a ferritic stainless steel foil that has been formed into a predetermined shape (e.g., honeycomb shape) and subjected to bonding may be subjected to the oxidation treatment.

The production process more preferably includes, as a heat pretreatment, a step in which the above-described heat pretreatment is performed in a reducing atmosphere or in a vacuum of 1.0×10 Pa or less and $1.0\times10^{-5}$ Pa or more. Performing such a pretreatment further increases the adhesion of the catalyst carrier for exhaust gas purifying facilities to a catalyst coat.

Bonding means such as brazing and diffusion bonding can be employed when the material, that is, the ferritic stainless steel foil, is formed into a predetermined shape and subjected to bonding. In general, brazing, diffusion bonding, and the like require a heat treatment in which a temperature of 800° C. to 1200° C. is maintained in a reducing atmosphere or in vacuum. Therefore, the above-described heat pretreatment may also serve as a heat treatment for brazing or diffusion bonding. When a bright annealing treatment step is conducted as the final step of the process of producing the ferritic stainless steel foil to perform recrystallization subsequent to cold rolling, the above-described heat pretreatment may also serve as the bright annealing treatment step of the process of producing the ferritic stainless steel foil.

Thus, it is possible to increase adhesion of the catalyst carrier for exhaust gas purifying facilities to a catalyst coat without adding any additional step to a common production method.

EXAMPLES

Steels having the chemical compositions shown in Table 1, which were prepared by vacuum melting, were heated to 1200° C. and subsequently hot-rolled at 900° C. or more and 1200° C. or less. Thus, hot-rolled sheets having a thickness of 3 mm were prepared. The hot-rolled sheets were annealed in the air (annealing temperature: 1000° C., holding time at the annealing temperature: 1 minute), and scale was removed from the annealed sheets by pickling. Thus, hot-rolled annealed sheets were prepared. The hot-rolled annealed sheets were then cold-rolled. Thus, cold-rolled sheets having a thickness of 1 mm were prepared. The cold-rolled sheets were annealed (atmosphere gas: $N_2$ gas, annealing temperature: 900° C. or more and 1050° C. or less, residence time at the annealing temperature: 1 minute). Subsequently, the cold-rolled sheets were pickled and then repeatedly subjected to cold rolling by a cluster mill and annealing (atmosphere gas: $N_2$ gas, annealing temperature: 900° C. or more and 1050° C. or less, residence time at the annealing temperature: 1 minute) plural times. Thus, foils having a width of 100 mm and a thickness of 50 μm were prepared.

The hot-rolled annealed sheets and foils prepared in the above-described manner were evaluated in terms of the toughness of the hot-rolled annealed sheet (production efficiency of the foil), the shape stability of the foil at high temperatures, the oxidation resistance of the foil, and the adhesion of the foil to a catalyst coat. The evaluations were made as follows.

(1) Toughness of Hot-Rolled Annealed Sheet (Production Efficiency of Foil)

The toughness of the hot-rolled annealed sheet was measured by a Charpy impact test to evaluate the consistent-threading performance of the hot-rolled annealed sheet in a cold rolling step. A Charpy specimen was taken from each of the hot-rolled annealed sheets having a thickness of 3 mm prepared by the above-described method such that the longitudinal direction of the specimen was parallel to the rolling direction. A V-notch was formed in each specimen in a direction perpendicular to the rolling direction. The specimens were prepared in accordance with the V-notch specimen described in a JIS standard (JIS Z 2202(1998)) except that the thickness (width in the JIS standard) of the specimen was not changed from the thickness of the original specimen, that is, 3 mm. In accordance with a JIS standard (JIS Z 2242(1998)), three specimens were tested for each temperature, and the amount of absorbed energy and the fraction of brittle fracture surface were measured. Thus, a transition curve was obtained. The temperature at which the transition curve of the fraction of brittle fracture surface reached 50% was considered to be the ductile-brittle transition temperature (DBTT).

When the DBTT determined by the Charpy impact test is 75° C. or less, it is possible to thread the hot-rolled annealed sheet through an annealing-pickling line and a cold-rolling line in which the hot-rolled annealed sheet is repeatedly bent, consistently at normal temperature. The DBTT is preferably less than 25° C. in an environment such as the winter season in cold-climate areas in which the sheet temperature is likely to be reduced.

Accordingly, an evaluation of "Toughness of hot-rolled annealed sheet (production efficiency of the foil): Excellent (⊙)" was given when the DBTT was less than 25° C.; an evaluation of "Toughness of hot-rolled annealed sheet (production efficiency of the foil): Good (○)" was given when the DBTT was 25° C. or more and 75° C. or less; and an evaluation of "Toughness of hot-rolled annealed sheet (production efficiency of the foil): Poor (x)" was given when the DBTT was more than 75° C. Table 2 summarizes the results.

(2) Shape Stability of Foil at High Temperatures

Specimens having a width of 100 mm and a length of 50 mm were taken from each of the foils having a thickness of 50 μm prepared by the above-described method. The specimens were wound in the longitudinal direction to form a cylindrical shape having a diameter of 5 mm, and the edge portions were fixed in place by spot welding. Thus, three cylindrical specimens were prepared from each of the foils. The specimens were heated in an air atmosphere furnace at 800° C. for 400 hours and subsequently cooled to the room temperature, simulating the service environment. The average of the amounts of dimensional changes of the three cylindrical specimens (ratio of an increase in the length of the cylindrical specimen after heating and cooling to the length of the cylindrical specimen before heating) was measured. An evaluation of "Shape stability of foil at high temperatures: Excellent (⊙)" was given when the average dimensional change was less than 3%. An evaluation of "Shape stability of foil at high temperatures: Good (○)" was given when the average dimensional change was 3% or more and 5% or less. An evaluation of "Shape stability of foil at high temperatures: Poor (x)" was given when the average dimensional change was more than 5%. Table 2 summarizes the results.

(3) Oxidation Resistance of Foil

Three specimens having a width of 20 mm and a length of 30 mm were taken from each of the foils having a thickness of 50 μm prepared by the above-described method. The specimens were heated at 800° C. for 400 hours in an air atmosphere furnace. Subsequently, the average of increases in weights of the three specimens due to oxidation (quotient obtained by dividing the weight change that occurred during heating by the initial surface area) was measured. An evaluation of "Oxidation resistance of foil: Excellent (⊙)" was given when the average weight increase due to oxidation was less than 2 $g/m^2$. An evaluation of "Oxidation resistance of foil: Good (○)" was given when the average weight increase due to oxidation was 2 $g/m^2$ or more and 4 $g/m^2$ or less. An evaluation of "Oxidation resistance of foil: Poor (x)" was given when the average weight increase due to oxidation was more than 4 $g/m^2$. Table 2 summarizes the results.

(4) Adhesion of Foil to Catalyst Coat

To simulate a wash coat used for depositing a catalyst on the foil, the foils were coated with a solution of "ALUMINASOL 200" (produced by Nissan Chemical Industries, Ltd.). The resulting foils were evaluated in terms of peeling resistance.

A method of testing the adhesion of the foil to a catalyst coat is described below. Three specimens having a width of 20 mm and a length of 30 mm were taken from each of the foils having a thickness of 50 μm prepared by the above-described method. Subsequently, the solution of "ALUMINASOL 200" was applied to the specimens such that the thickness of the coating film was 50 μm per side of the specimen. The specimens were dried at 250° C. for 2.5 hours and subsequently baked at 700° C. for 2 hours. Thus, a $\gamma$-$Al_2O_3$ layer simulating a wash coat was formed on both surfaces of each specimen.

The specimens prepared as described above, on which the $\gamma$-$Al_2O_3$ layer was formed, were subjected to a peeling test in the following manner. The specimens were maintained in the air at 800° C. for 30 minutes. Subsequently, the specimens were taken out from the furnace and air-cooled to the room temperature. The specimens were then subjected to ultrasonic cleaning in water for 10 seconds (water temperature: about 25° C., frequency of the ultrasonic wave: 30 kHz). The specimens were evaluated in terms of adhesion to a catalyst coat by measuring the average (average over the three specimens) ratio of the change in weight which occurred during cleaning (peeling ratio). An evaluation of "Adhesion of foil to catalyst coat: Excellent (⊙)" was given when the average ratio of weight change (peeling ratio) was less than 15%. An evaluation of "Adhesion of foil to catalyst coat: Good (○)" was given when the average ratio of weight change (peeling ratio) was 15% or more and 30% or less. An evaluation of "Adhesion of foil to catalyst coat: Poor (x)" was given when the average ratio of weight change (peeling ratio) was more than 30%. Table 2 summarizes the results.

To examine the impact of the surface oxide layer on the adhesion of the foil to a catalyst coat, foils on which an oxide layer was formed were also tested in terms of adhesion to a catalyst coat.

Specimens having a width of 20 mm and a length of 30 mm were taken from each of the foils having a thickness of 50 μm prepared by the above-described method. The specimens were subjected to an oxidation treatment or to a heat pretreatment and an oxidation treatment under the conditions shown in Table 3. Thus, an oxide layer was formed on the surface of each specimen. Subsequently, the specimens, on which an oxide layer was formed, were coated with the solution of "ALUMINASOL 200" such that the thickness of the coating film was 50 μm per side of the specimen as in the method described above. The specimens were dried at 250° C. for 2.5 hours and subsequently baked at 700° C. for 2 hours. Thus, a $\gamma$-$Al_2O_3$ layer simulating a wash coat was formed on both surfaces of each specimen.

Figure 4:
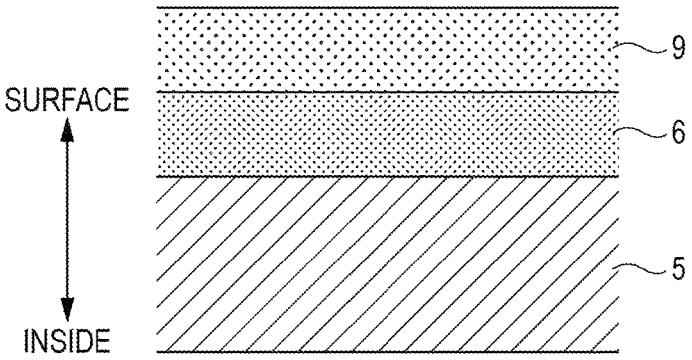
FIG. 4 is a schematic diagram illustrating an example of a cross section of the surface of a stainless steel foil on which an oxide layer is deposited, where a $\gamma$-$Al_2O_3$ coat (wash coat) is formed on the oxide layer.

FIG. 4 is a schematic diagram illustrating a cross section of a specimen on which a $\gamma$-$Al_2O_3$ layer was formed. In the specimen on which the $\gamma$-$Al_2O_3$ layer was formed, an oxide layer 6 is formed on the surface layer of a base iron 5. The surface layer of the oxide layer is coated with a $\gamma$-$Al_2O_3$ layer 9. The coated specimens were subjected to a peeling test in the following manner. This peeling test was conducted under more severe conditions than those used for the above-described peeling test.

To simulate repeated thermal stress that occurs under the service conditions, the specimens were repeatedly subjected to a heat treatment 200 times in total, in which the specimen was maintained at 800° C. for 30 minutes and subsequently air-cooled to the room temperature. The specimens were then subjected to ultrasonic cleaning in water for 10 seconds (water temperature: about 25° C., frequency of the ultrasonic wave: 30 kHz). The specimens were evaluated in terms of adhesion to a catalyst coat by measuring the ratio of the change in weight which occurred during cleaning (peeling ratio). An evaluation of "Adhesion of foil to catalyst coat: Excellent (⊙)" was given when the ratio of weight change (peeling ratio) was less than 20%. An evaluation of "Adhesion of foil to catalyst coat: Good (○)" was given when the ratio of weight change (peeling ratio) was 20% or more and 40% or less. An evaluation of "Adhesion of foil to catalyst coat: Poor (x)" was given when the ratio of weight change (peeling ratio) was more than 40%.

For each of the specimens prepared under various conditions which had been subjected to the oxidation treatment (specimens on which the $Al_2O_3$ layer simulating a wash coat had not been formed), the thickness of the oxide layer (distance between the points a and c in FIG. 2), the type of the oxide layer, and the area fraction of the Al oxide layer in the surface of the oxide layer were determined by the above-described method.

Table 3 summarizes the results.

TABLE 1

| Steel | Chemical composition (mass %) | | | | | | | | | | | | | | |
|---|---|---|---|---|---|---|---|---|---|---|---|---|---|---|---|
| No. | C | Si | Mn | P | S | Cr | Ni | Al | Cu | N | Ti | Zr | Hf | Others | Remarks |
| 1 | 0.009 | 0.14 | 0.13 | 0.030 | 0.0020 | 11.3 | 0.12 | 2.1 | 0.02 | 0.014 | 0.21 | — | — | — | Our example |
| 2 | 0.013 | 0.10 | 0.10 | 0.031 | 0.0025 | 15.3 | 0.12 | 2.1 | 0.10 | 0.011 | 0.24 | — | — | — | Our example |
| 3 | 0.012 | 0.14 | 0.13 | 0.023 | 0.0021 | 18.4 | 0.16 | 1.9 | 0.13 | 0.010 | 0.19 | — | — | — | Our example |
| 4 | 0.007 | 0.10 | 0.12 | 0.022 | 0.0021 | 11.4 | 0.10 | 2.0 | 0.04 | 0.011 | 0.21 | — | — | — | Our example |
| 5 | 0.008 | 0.08 | 0.07 | 0.023 | 0.0015 | 15.3 | 0.18 | 2.9 | 0.05 | 0.012 | 0.23 | — | — | — | Our example |
| 6 | 0.009 | 0.13 | 0.12 | 0.031 | 0.0014 | 15.5 | 0.15 | 1.7 | 0.06 | 0.010 | — | 0.15 | — | — | Our example |
| 7 | 0.010 | 0.10 | 0.15 | 0.038 | 0.0012 | 15.0 | 0.13 | 1.9 | 0.02 | 0.014 | — | — | 0.08 | — | Our example |
| 8 | 0.006 | 0.12 | 0.11 | 0.029 | 0.0021 | 15.1 | 0.17 | 2.0 | 0.91 | 0.009 | 0.18 | — | — | Ca: 0.0045, Mg: 0.0032 | Our example |
| 9 | 0.011 | 0.07 | 0.08 | 0.038 | 0.0024 | 11.3 | 0.10 | 2.1 | 0.05 | 0.007 | 0.23 | — | — | Ca: 0.0051, Mg: 0.0034 | Our example |
| 10 | 0.006 | 0.13 | 0.12 | 0.031 | 0.0011 | 11.4 | 0.13 | 2.0 | 0.05 | 0.008 | — | 0.05 | — | Ca: 0.0034, Mg: 0.0086 | Our example |
| 11 | 0.007 | 0.14 | 0.11 | 0.037 | 0.0013 | 15.3 | 0.13 | 2.3 | 0.06 | 0.009 | 0.23 | — | 0.04 | La: 0.081 | Our example |
| 12 | 0.013 | 0.12 | 0.14 | 0.034 | 0.0010 | 15.4 | 0.12 | 2.1 | 0.34 | 0.008 | 0.21 | — | — | La + Ce: 0.024 | Our example |
| 13 | 0.011 | 0.11 | 0.10 | 0.039 | 0.0022 | 15.1 | 0.19 | 2.0 | 0.51 | 0.008 | 0.19 | — | — | Y + Ce: 0.035, Nb: 0.45 | Our example |
| 14 | 0.013 | 0.10 | 0.14 | 0.025 | 0.0015 | 15.0 | 0.20 | 2.1 | 0.81 | 0.013 | 0.15 | — | — | Mo: 0.51 | Our example |
| 15 | 0.013 | 0.13 | 0.11 | 0.026 | 0.0025 | 15.1 | 0.18 | 2.0 | 0.53 | 0.007 | 0.34 | — | — | W: 0.24, Co: 0.25 | Our example |
| 16 | 0.012 | 0.15 | 0.14 | 0.025 | 0.0018 | 11.3 | 0.12 | 0.4 | 0.31 | 0.010 | 0.41 | — | — | — | Comparative example |
| 17 | 0.006 | 0.10 | 0.10 | 0.034 | 0.0014 | 20.8 | 0.14 | 2.1 | 0.34 | 0.008 | 0.23 | — | — | — | Comparative example |
| 18 | 0.011 | 0.10 | 0.12 | 0.025 | 0.0013 | 15.1 | 0.16 | 1.3 | 0.06 | 0.013 | 0.29 | — | — | — | Comparative example |
| 19 | 0.012 | 0.09 | 0.11 | 0.037 | 0.0015 | 15.3 | 0.16 | 4.0 | 0.05 | 0.012 | 0.27 | — | — | — | Comparative example |
| 20 | 0.010 | 0.10 | 0.13 | 0.030 | 0.0022 | 11.3 | 0.13 | 2.1 | — | 0.013 | 0.24 | — | — | — | Comparative example |
| 21 | 0.008 | 0.24 | 0.12 | 0.032 | 0.0021 | 11.5 | 0.15 | 2.0 | — | 0.013 | 0.25 | — | — | — | Comparative example |
| 22 | 0.009 | 0.12 | 0.22 | 0.029 | 0.0020 | 11.2 | 0.13 | 2.2 | — | 0.013 | 0.23 | — | — | — | Comparative example |

TABLE 2

| | Properties of foil at high temperatures | | | | | | | | |
|---|---|---|---|---|---|---|---|---|---|
| | Toughness of hot-rolled annealed sheet | | Shape stability | | Oxidation resistance: Weight increase due to oxidation | | Adhesion to catalyst coat: Peeling ratio | | |
| Steel No | DBTT (° C.) | Evaluation | Dimensional change (%) | Evaluation | ($g/m^2$) | Evaluation | (%) | Evaluation | Remarks |
| 1 | −5 | ⊙ | 3.2 | ○ | 3.5 | ○ | 19 | ○ | Our example |
| 2 | 20 | ⊙ | 2.2 | ⊙ | 1.5 | ⊙ | 16 | ○ | Our example |
| 3 | 30 | ○ | 1.6 | ⊙ | 1.6 | ⊙ | 17 | ○ | Our example |
| 4 | −10 | ⊙ | 3.7 | ○ | 2.9 | ○ | 25 | ○ | Our example |
| 5 | 25 | ○ | 2.2 | ⊙ | 1.3 | ⊙ | 20 | ○ | Our example |
| 6 | 40 | ○ | 3.2 | ○ | 3.1 | ○ | 19 | ○ | Our example |
| 7 | 15 | ⊙ | 3.8 | ○ | 2.8 | ○ | 26 | ○ | Our example |
| 8 | 20 | ⊙ | 1.4 | ⊙ | 1.8 | ⊙ | 21 | ○ | Our example |
| 9 | −15 | ⊙ | 3.9 | ○ | 3.4 | ○ | 23 | ○ | Our example |
| 10 | 25 | ○ | 4.1 | ○ | 1.5 | ⊙ | 27 | ○ | Our example |
| 11 | 10 | ⊙ | 2.1 | ⊙ | 1.1 | ⊙ | 16 | ○ | Our example |
| 12 | 5 | ⊙ | 1.8 | ⊙ | 1.0 | ⊙ | 12 | ⊙ | Our example |
| 13 | 10 | ⊙ | 1.5 | ⊙ | 1.4 | ⊙ | 11 | ⊙ | Our example |
| 14 | 30 | ○ | 1.8 | ⊙ | 2.9 | ○ | 16 | ○ | Our example |
| 15 | 35 | ○ | 1.3 | ⊙ | 1.7 | ⊙ | 13 | ⊙ | Our example |
| 16 | −30 | ⊙ | 8.7 | X | 5.9 | X | 89 | X | Comparative example |
| 17 | 100 | X | 1.3 | ⊙ | 1.5 | ⊙ | 12 | ⊙ | Comparative example |
| 18 | 20 | ⊙ | 7.2 | X | 4.9 | X | 84 | X | Comparative example |
| 19 | 90 | X | 2.1 | ⊙ | 1.5 | ⊙ | 15 | ○ | Comparative example |
| 20 | −10 | ⊙ | 6.8 | X | 3.4 | ○ | 75 | X | Comparative example |
| 21 | 10 | ⊙ | 1.8 | ⊙ | 1.2 | ⊙ | 37 | X | Comparative example |
| 22 | 5 | ⊙ | 6.7 | X | 4.8 | X | 78 | X | Comparative example |

TABLE 3

| Specimen | Steel No. | Heat treatment conditions: Heat pretreatment | Heat treatment conditions: Oxidation treatment | Type of oxide layer | Area fraction of Al oxide layer (%) | Thickness of oxide layer (μm) | Adhesion to catalyst coat: Peeling ratio (%) | Adhesion to catalyst coat: Evaluation | Remarks |
|---|---|---|---|---|---|---|---|---|---|
| A | 1 | 1200° C. × 30 min (in vacuum*1) | 900° C. × 5 hr (in air) | Composite layer*2 | 44 | 3.5 | 12 | ⊙ | Our example |
| B | 2 | 1200° C. × 30 min (in vacuum*1) | 900° C. × 5 hr (in air) | Composite layer*2 | 51 | 2.9 | 10 | ⊙ | Our example |
| C | 3 | None | 900° C. × 5 hr (in air) | Composite layer*2 | 35 | 2.3 | 19 | ⊙ | Our example |
| D | 4 | 1200° C. × 30 min (in vacuum*1) | 900° C. × 5 hr (in air) | Composite layer*2 | 50 | 4.1 | 9 | ⊙ | Our example |
| E | 5 | 1200° C. × 30 min (in vacuum*1) | 900° C. × 5 hr (in air) | Composite layer*2 | 82 | 2.1 | 6 | ⊙ | Our example |
| F | 6 | 950° C. × 30 min (75% $H_2$—25% $N_2$) | 900° C. × 5 hr (in air) | Composite layer*2 | 45 | 2.9 | 8 | ⊙ | Our example |
| G | 7 | 1200° C. × 30 min (in vacuum*1) | 900° C. × 5 hr (in air) | Composite layer*2 | 35 | 3.2 | 11 | ⊙ | Our example |
| H | 8 | None | None | None | 0 | <0.1 | 38 | ○ | Our example |
| I | | 1200° C. × 30 min (in vacuum*1) | 900° C. × 30 sec (in air) | Composite layer*2 | Unable to be measured | 0.2 | 31 | ○ | Our example |
| J | | None | 900° C. × 30 sec (in air) | Composite layer*2 | Unable to be measured | 0.1 | 33 | ○ | Our example |
| K | | 1200° C. × 30 min (in vacuum*1) | 800° C. × 5 hr (in air) | Composite layer*2 | 48 | 1.1 | 9 | ⊙ | Our example |
| L | | None | 800° C. × 5 hr (in air) | Composite layer*2 | 41 | 1.0 | 19 | ⊙ | Our example |
| M | | 950° C. × 30 min (in vacuum*1) | 900° C. × 5 hr (in air) | Composite layer*2 | 52 | 2.3 | 6 | ⊙ | Our example |
| N | | None | 900° C. × 5 hr (in air) | Composite layer*2 | 37 | 2.1 | 15 | ⊙ | Our example |
| O | | 1100° C. × 30 min (in vacuum*1) | 1000° C. × 5 hr (in air) | Composite layer*2 | 59 | 4.1 | 11 | ⊙ | Our example |
| P | | None | 1000° C. × 5 hr (in air) | Composite layer*2 | 45 | 3.9 | 18 | ⊙ | Our example |
| Q | | 1200° C. × 30 min (75% $H_2$—25% $N_2$) | 900° C. × 5 hr (in air) | Composite layer*2 | 56 | 2.1 | 5 | ⊙ | Our example |
| R | | 1200° C. × 30 min (75% $H_2$—25% $N_2$) | 900° C. × 10 hr (in air) | Composite layer*2 | 58 | 3.2 | 7 | ⊙ | Our example |
| S | 9 | 1200° C. × 30 min (in vacuum*1) | 900° C. × 5 hr (in air) | Composite layer*2 | 61 | 1.9 | 7 | ⊙ | Our example |
| T | 10 | 1200° C. × 30 min (in vacuum*1) | 900° C. × 5 hr (in air) | Composite layer*2 | 43 | 3.4 | 14 | ⊙ | Our example |
| U | 11 | 1200° C. × 30 min (in vacuum*1) | 900° C. × 5 hr (in air) | Composite layer*2 | 82 | 1.5 | 8 | ⊙ | Our example |
| V | 12 | None | 900° C. × 5 hr (in air) | Composite layer*2 | 25 | 2.8 | 19 | ⊙ | Our example |
| W | 8 | None | 750° C. × 24 hr (in air) | Composite layer*2 | 14 | 1.5 | 33 | ○ | Our example |

*1Degree of vacuum: <1.0 × 10 Pa

*2Composite layer of Al oxide layer ($Al_2O_3$) and Cr oxide layer ($Cr_2O_3$)

As shown in Table 2, in our examples, the toughness of the hot-rolled sheet, the shape stability of the foil at high temperatures, the oxidation resistance of the foil, and the adhesion of the foil to a catalyst coat were excellent. In particular, since the hot-rolled sheets prepared in our examples had high toughness, it was possible to produce the ferritic stainless steel foils using an ordinary stainless steel production equipment in an efficient manner. On the other hand, in the Comparative examples, at least one property selected from the toughness of the hot-rolled sheet, the shape stability of the foil at high temperatures, the oxidation resistance of the foil, and the adhesion of the foil to a catalyst coat was poor.

As shown in Table 3, the specimens that had been adequately subjected to an oxidation treatment or to a heat pretreatment and an oxidation treatment to form an oxide layer thereon such that the area fraction of the Al oxide layer was 20% or more had higher adhesion to a catalyst coat than the specimen H, which had not been subjected to an oxidation treatment. The specimens in which the area fraction of the Al oxide layer was 20% or more had markedly higher adhesion to a catalyst coat than the specimens I and J, in which the thickness of the oxide layer was 0.2 μm or less since the oxidation treatment time was set to be short, that is, 30 sec, and the specimen W, in which the area fraction of the Al oxide layer was small, that is, 14%, since the oxidation treatment was performed at 750° C. for 24 hr.

We found from the above-described results that the ferritic stainless steel foils prepared in our examples had high adhesion to a catalyst coat as well as good production efficiency and good high-temperature properties.

INDUSTRIAL APPLICABILITY

It is possible to produce a ferritic stainless steel foil suitably used as a material of a catalyst carrier for exhaust gas purifying facilities in which the maximum temperature reached by the exhaust gas is relatively low using ordinary stainless steel production equipment in an efficient manner, which is markedly effective from an industrial viewpoint.

The invention claimed is:

1. A ferritic stainless steel foil comprising a composition containing, by mass %:

C: 0.050% or less, Si: 0.20% or less,

Mn: 0.20% or less, P: 0.050% or less,

S: 0.0050% or less, Cr: 10.5% or more and 20.0% or less,

Ni: 0.01% or more and 1.00% or less, Al: more than 1.5% and less than 3.0%,

Cu: 0.01% or more and 1.00% or less, N: 0.10% or less, and one or more elements selected from Ti: 0.01% or more and 1.00% or less, Zr: 0.01% or more and 0.20% or less, and Hf: 0.01% or more and 0.20% or less, and the balance being Fe and inevitable impurities, and a composite layer including an Al oxide layer and a Cr oxide layer, the composite layer being disposed on a surface of the ferritic stainless steel foil, wherein the area fraction of the Al oxide layer is 20% or more and the thickness of the composite layer is 1.0 μm to 10 μm.

2. The ferritic stainless steel foil according to claim 1, wherein the composition further contains, by mass %, one or more elements selected from Ca: 0.0010% or more and 0.0300% or less, Mg: 0.0015% or more and 0.0300% or less, and REM: 0.01% or more and 0.20% or less.

3. The ferritic stainless steel foil according to claim 2, wherein the composition further contains, by mass %, one or more elements selected from Nb: 0.01% or more and 1.00% or less, Mo: 0.01% or more and 3.00% or less, W: 0.01% or more and 3.00% or less, and Co: 0.01% or more and 3.00% or less such that the total content of the one or more elements is 0.01% or more and 3.00% or less.

4. The ferritic stainless steel foil according to claim 1, wherein the composition further contains, by mass %, one or more elements selected from Nb: 0.01% or more and 1.00% or less, Mo: 0.01% or more and 3.00% or less, W: 0.01% or more and 3.00% or less, and Co: 0.01% or more and 3.00% or less such that the total content of the one or more elements is 0.01% or more and 3.00% or less.

* * * * *